US006326344B1

(12) United States Patent
Levitt

(10) Patent No.: US 6,326,344 B1
(45) Date of Patent: Dec. 4, 2001

(54) CARPET SPOT REMOVAL COMPOSITION

(75) Inventor: Mark Dennis Levitt, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/491,915

(22) Filed: Jan. 27, 2000

(51) Int. Cl.[7] ..... C11D 3/12; C11D 3/43

(52) U.S. Cl. ..... 510/278; 510/279; 510/280; 510/434; 510/476; 510/477; 510/533

(58) Field of Search ..... 510/278–280, 510/434, 476, 477, 533

(56) References Cited

U.S. PATENT DOCUMENTS

| | | | | |
|---|---|---|---|---|
| 4,279,796 | | 7/1981 | Tarkinson | 260/29.6 R |
| 4,414,128 | | 11/1983 | Goffinet | 252/111 |
| 4,490,270 | | 12/1984 | Hackett et al. | 252/106 |
| 4,659,494 | * | 4/1987 | Soldanski et al. | 252/88 |
| 4,758,641 | * | 7/1988 | Hsu | 526/208 |
| 4,802,997 | * | 2/1989 | Fox et al. | 252/8.6 |
| 5,004,557 | * | 4/1991 | Nagarajan et al. | 252/174.24 |
| 5,252,243 | | 10/1993 | Minns | 252/102 |
| 5,259,848 | | 11/1993 | Terry et al. | 8/111 |
| 5,284,597 | | 2/1994 | Rees | 252/103 |
| 5,338,475 | | 8/1994 | Corey et al. | 252/102 |
| 5,348,556 | | 9/1994 | Minns et al. | 8/137 |
| 5,389,278 | | 2/1995 | Minns et al. | 252/102 |
| 5,395,555 | | 3/1995 | Colurciello et al. | 252/546 |
| 5,429,684 | | 7/1995 | Osberghaus et al. | 134/3 |
| 5,439,610 | | 8/1995 | Ryan et al. | 252/174.23 |
| 5,514,302 | | 5/1996 | Brown | 252/545 |
| 5,534,167 | * | 7/1996 | Billman | 510/280 |
| 5,536,438 | | 7/1996 | Scialla et al. | 510/372 |
| 5,580,495 | | 12/1996 | Young | 510/340 |
| 5,591,236 | * | 1/1997 | Roetker | 8/137 |
| 5,624,465 | | 4/1997 | Harris | 8/137 |
| 5,712,240 | | 1/1998 | Tyereche et al. | 510/424 |
| 5,718,729 | | 2/1998 | Harris | 8/137 |
| 5,728,669 | | 3/1998 | Tyerech | 510/280 |
| 5,783,543 | | 7/1998 | Fleckenstein et al. | 510/280 |
| 5,786,317 | | 7/1998 | Townsend | 510/278 |
| 5,837,665 | | 11/1998 | Young | 510/278 |
| 5,905,065 | | 5/1999 | Scialla et al. | 510/280 |
| 5,905,066 | | 5/1999 | Zocchi et al. | 510/280 |
| 5,955,413 | | 9/1999 | Campagna et al. | 510/278 |
| 5,968,204 | | 10/1999 | Wise | 8/142 |
| 6,048,368 | * | 4/2000 | Tcheou et al. | 8/137 |

FOREIGN PATENT DOCUMENTS

| | | | | |
|---|---|---|---|---|
| 2 272 216 | * | 12/1975 | (FR) | D06M/15/30 |

* cited by examiner

*Primary Examiner*—Yogendra N. Gupta
*Assistant Examiner*—Brian P. Mruk
(74) *Attorney, Agent, or Firm*—Vidas, Arrett & Steinkrau

(57) ABSTRACT

The present invention relates to a carpet cleaning composition comprising about 50% by weight to about 98% by weight water; about 0.05% by weight to about 2% wt-% of at least one emulsifier that is an acrylic copolymer; about 1% by weight to about 50% by weight of at least one solvent; 0% to about 1% by weight of at least one surfactant; and at least one alkaline compound for buffering. The resultant cleaning composition has an adjusted pH from about 4 to about 10.

28 Claims, No Drawings

CARPET SPOT REMOVAL COMPOSITION

FIELD OF THE INVENTION

The present invention relates to a carpet cleaning composition comprising a polyacrylic acid polymer emulsifier that requires little or no surfactant so as to provide a cleaning composition that does not leave a sticky residue when dry. The compositions of the present invention are free from fluorochemicals.

BACKGROUND OF THE INVENTION

Carpets are usually finished with several different types of treatments including gloss, stainblocking, anti-static, and water and oil repellency.

One finish that is often applied to a carpet provides the carpet with "soil resistance" or "anti-resoiling". This property prevents subsequent soils from adhering to carpets as a result of normal use such as foot traffic on carpets, thus making vacuuming more efficient. Carpets vary tremendously in their anti-soiling properties. The finish may increase the efficacy of the carpet to resist staining, but unfortunately, soiling will occur.

Furthermore, whether or not a carpet has such a finish, cleaning the carpet with a poorly formulated carpet cleaning solution can work in opposition to any soil resistant properties that the carpet may have once had. For instance, cleaning compositions containing sticky materials such as oily materials, sticky detergents and water absorbent materials such as hygroscopic salts can leave a tacky or sticky residue that would attract dirt or dust. Thus it is often expressed that freshly cleaned carpets often "get dirty faster" than a new carpet.

Surfactants are typically used in carpet cleaning solutions and contribute to the effectiveness of the cleaning power and act to emulsify any water-insoluble solvents that may be present for oily soil removal. However, surfactants often leave a sticky residue once the cleaning solution has dried, particularly if high concentrations of surfactants are used.

A variety of carpet cleaning compositions are available on the market today. Most of these are composed of polymeric resins and surfactants and solvents, and are typically in liquid or aerosol form, although powders are available as well.

Some of these cleaning solutions have been formulated so as to minimize he tacky residue left behind. For instance, French Pat. No. 2,272,216 describes the leaning as well as the antistatic and antisoiling dressing of textile materials such as rugs and carpets by means of foaming aqueous emulsions which, upon drying, leave on the fiber a solid nonsticky residue which can be removed by means of brushing or vacuuming.

U.S. Pat. No. 5,534,167 to Billman describes a carpet cleaning and restoring composition which is composed of from about 0.5% to about 6.0% by weight of ethylene glycol n-hexyl ether; from about 0.05% to about 2.0% by weight of a water-soluble or water miscible fluorinated hydrocarbon which forms a water and oil repellent surface upon drying; from about 0.25% to about 5.0% by weight of a surfactant selected from the group consisting of nonionic surfactants and mixtures thereof; and from about 0.5% to about 7.0% by weight of a olefinic/acrylic polymer having an acid number from about 10 to about 450. Billman states that the composition forms a non-tacky, soil repellent residue upon drying and restores the water repellent finish of the carpet.

Surprisingly, the present invention provides a carpet cleaning solution comprising a novel polymeric emulsifier that has excellent cleaning properties and that requires little or no surfactant for good emulsification, and consequently does not leave a tacky residue on the carpet once the solution has dried. Furthermore, the compositions are free from fluorochemicals.

SUMMARY OF THE INVENTION

The present invention relates to a carpet cleaning composition comprising about 50% by weight to about 98% by weight water; about 0.05% by weight to about 2% by weight of at least one emulsifier that is an acid copolymer; about 1% by weight to about 50% by weight of at least one hydrocarbon; 0% to about 1% by weight of a surfactant; and at least one alkaline compound for buffering. The resultant cleaning composition has an adjusted pH from about 5 to about 10. The composition is prepared by mixing.

Surprisingly, due to the extremely low concentrations of emulsifier, and the fact that little or no surfactant is used in the cleaning compositions of the present invention, the final air dried residue is not tacky or sticky to the touch. This is especially useful for carpet cleaning where remaining tack can attract dust and dirt particles decreasing the lifetime of the carpet, for instance.

DETAILED DESCRIPTIONS OF THE PREFERRED EMBODIMENTS

The composition of the present invention comprises at least one active ingredient which is a synthetic polymer. The active ingredient in the present invention not only functions as a cleaning agent, but also functions as an emulsifier, hereinafter referred to as such. These emulsifiers are high molecular weight polymers of unsaturated acid monomers or salts thereof. The emulsifiers suitably have a structure that comprises a lipophilic or oil-loving portion and a hydrophilic or water-loving portion.

The emulsifier is suitably a copolymer of an olefinically unsaturated carboxylic acid or acid salt, as a principle monomer, and a secondary, non-acidic monomer. Suitably the copolymer is a high molecular weight copolymer or a cross-linked copolymer and has both lipophilic and hydrophilic structures on the polymer molecule.

The principle monomers used to prepare the emulsifier are olefinically unsaturated monocarboxylic and dicarboxylic acids and salts thereof containing 3 to 5 carbon atoms, preferably monocarboxylic acids, salts and anhydrides thereof. Preferred olefinically unsaturated acids have the following general structure:

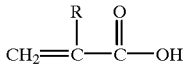

wherein R is a substituent selected from the class consisting of hydrogen, halogen, and cyano groups, monovalent alkyl radicals, monovalent aryl radicals, monovalent aralkyl radicals, monovalent alkaryl radicals, and monovalent cycloaliphatic radicals. Suitable monomers of this class include acrylic acid, methacrylic acid, ethacrylic acid, alpha-chloroacrylic acid and alpha-cyano acrylic acid. Acrylic acid, methacrylic acid, maleic acid and maleic anhydride are preferred because of generally lower cost, ready availability and ability to form superior polymers. Acrylic acid is most preferred.

Other olefinically unsaturated acids which may be used as the principle monomer in the emulsifier component of the invention include itaconic acid, maleic acid and fumeric acid. Anhydrides of such acids, for instance maleic anhydride, or a salt of such acids, such as sodium acrylate, may also be used as principle monomer.

The secondary monomers or comonomers are selected from those monomers which contain at least one terminal $CH_2{=}C<$ or vinylidene group. Such comonomers include acrylic esters:

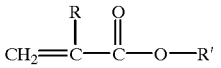

wherein R is as previously defined and R' is an optionally substituted alkyl group containing 1–30 carbon atoms. This group of comonomers includes the acrylic acid esters with aliphatic groups wherein R' contains 1–30, preferably 2–20 carbon atoms. The R' alkyl group can also be substituted with alkoxy, halo, cyano, and the like, or interrupted with multiple ether oxygen atoms. In these comonomers, R is preferably hydrogen, or lower alkyl such as methyl, or ethyl group and preferably methyl. Examples of the aliphatic acrylic esters include decyl acrylate, isodecyl acrylate, lauryl acrylate, stearyl acrylate, behenyl acrylate, melissyl acrylate, methyl acrylate, ethyl acrylate, propyl acrylate, isopropyl acrylate, n-butyl acrylate, isobutyl acrylate, n-hexyl acrylate, heptyl acrylate, octyl acrylate, ethylhexyl acrylate, and the corresponding methacrylates, and so forth.

Mixtures of two or three or more of the acrylic esters may be successfully polymerized with one of the carboxylic acid monomers. One useful class of copolymers are those methacrylates where the alkyl group contains 10 to 20 carbon atoms. Typical polymers have been made with about 15 weight percent isodecyl methacrylate, about 10 weight percent lauryl methacrylate, and about 7 weight percent stearyl methacrylate, with acrylic acid.

Other vinylidene comonomers which may also be used, particularly in conjunction with acrylic esters, include olefinically unsaturated nitriles, preferably the monoolefinically unsaturated nitriles having from 3 to 10 carbon atoms such as acrylonitrile, methacrylonitrile, and the like. Most preferred are acrylonitrile and methacrylonitrile. The amounts used, for example, for some polymers are from about 5 to 30 weight percent of the total monomers copolymerized.

Amide monomers may also be employed as comonomers, again particularly in conjunction with acrylic esters. Such monomers are preferably monoolefinically unsaturated amides having at least one hydrogen on the amide nitrogen and the olefinic unsaturation is alpha-beta to the carbonyl group. Acrylamide and methacrylamide are preferred examples and may be used in amounts, for example, from about 1 to 30 weight percent of the total monomers copolymerized. Other amide monomers include N-alkylol amides of alpha, beta-olefinically unsaturated carboxylic acids including those having from 4 to 10 carbon atoms. The preferred monomers of the N-alkylol amide type are the N-alkylol amides of alpha, beta-monoolefinically unsaturated monocarboxylic acids and the most preferred are N-methylol acrylamide and N-methylol methacrylamide used in amounts, for example, of about 1 to 20 weight percent. N-alkoxymethyl acrylamides also may be used. The preferred alkoxymethyl acrylamides are those wherein the alkyl group contains from 2 to 5 carbon atoms, for instance N-butoxymethyl acrylamide.

Still other vinylidene comonomers which may be copolymerized with the monomers described above, in an amount of up to about 30% or more by weight of the total monomer, include α-olefins containing from 2 to 12 carbon atoms, such as ethylene and propylene; dienes containing from 4 to 10 carbon atoms, including butadiene; vinyl esters and allyl esters such as vinyl acetate; vinyl aromatics such as styrene; vinyl and allyl ethers and ketones such as vinyl methyl ether and methyl vinyl ketone; vinyl halides such as vinyl chloride, vinylidene chloride and the like; esters of maleic and fumaric acid; and the like.

The emulsifier copolymer may be non-crosslinked, or lightly crosslinked and may be functionally identified as water-soluble or water-swellable. Crosslinking may be accomplished by the inclusion of minor amounts of monomers having two or more olefinically unsaturated groups, for instance butadiene, isoprene, divinyl benzene, divinyl naphthalene, allyl acrylate, allyl methacrylate, ethylene glycol dimethacrylate, di- or higher allyl ethers of pentaerythritol, sucrose and trimethylolpropane, di or higher (meth)acryl esters of pentaerythritol, sucrose and trimethylolpropane, ethylene glycol di(meth)acrylatc, 1,6-hexane di(meth)acrylate, or the like. Typically such monomers are employed in amounts not more than 5% of total monomer weight, preferably from about 0.1 to about 2.0%.

The resultant acid copolymers preferably have acid numbers of about 10 to about 450. Such polymeric emulsifiers are discussed in U.S. Pat. No. 4,758,641 and U.S. Pat. No. 5,004,557 herein incorporated by reference in their entirety. Preferred polymers are lightly crosslinked copolymers of acrylic acid and an alkyl acrylate ester. A number of commercially available acid copolymers can be employed in the compositions of the invention. A preferred such copolymer is PEMULEN® 1622 available from B.F. Goodrich Co., Cleveland, Ohio.

The polymeric emulsifiers are employed in the compositions of the present invention from about 0.05% to about 2%, preferably from about 0.1% to about 1%, and most preferably from about 0.1% to about 0.5% by weight of the total composition. These polymers can achieve excellent emulsification without any, or at very low levels of surfactant.

Non-aqueous cleaning solvents are utilized in the compositions of the present invention. The solvents may be either non-volatile or volatile as defined by Federal Environmental Protection Agency, 40 CFR 59.203(f). Preferably, the solvents are volatile. Volatile solvents are defined by the Federal Regulations 40 CFR 59.203(f). having a vapor pressure of >0.1 mm Hg. Volatile solvents are preferable to the present invention because they leave less of a sticky residue than the non-volatile solvents. Such solvents are useful from about 1% to about 50% by weight of the composition, and preferably from about 3% to about 20% by weight and most preferably about 8% or less by weight of the composition.

The solvents useful herein are preferably water-insoluble solvents including both hydrocarbon and non-hydrocarbon solvents. Examples of such solvents are the paraffinic hydrocarbons including iso-, normal- and cycloparaffins; naphthenic hydrocarbons; higher water-insoluble alcohols; water-insoluble ketones; water-insoluble ethers; terpene based hydrocarbons of a cyclic nature including terpinenes, terpinolenes, limonenes such as d-limonene, dipentenes, pinenes such as α-pinene or β-pinene, and so forth; water-insoluble esters including methyl esters of caprylic, capric and caproic acids; DuPont DBE (dibasic ester solvents) which are methyl esters of adipic, glutaric, and succinic acids available from E.I. du Pont de Nemours and Co. in Wilmington, Del.; ethyl esters including EXXATE® esters available from Exxon Chemical Co. in Houston, Tex. which are esters of acetic acid; cyclic branched or linear completely alkylated siloxanes for example methylated siloxanes; and so forth. So-called "exempt" solvents are particularly desirable. An example of an exempt solvent is cyclic dimethyl siloxane. A particularly preferred cleaning solvent is an isoparaffinic hydrocarbon (commonly referred to as mineral spirits).

Optionally, a surfactant or blend of surfactants may be added to the compositions of the present invention. Such surfactants are added to improve the wet-out of the composition on the substrate, e.g. carpet, surface. The polymeric emulsifier of the present invention requires no surfactant in order to obtain good emulsification, but it is preferable to include a small amount of surfactant(s) in the present invention. The surfactants are useful from 0% to about 1%, preferably from about 0.01% to about 0.7%, more preferably from about 0.01% to about 0.6%, even more preferably from about 0.01% to about 0.5% by weight of the total composition and most preferably from about 0.03% to about 0.5% by weight of the total composition. In one preferred embodiment of the present invention, the surfactant is present at a concentration of about 0.07% and in another at a concentration of 0.5% by weight of the total composition. It is preferable to use low levels of surfactant so as to minimize or eliminate any sticky residue that may be left behind on the carpet surface. This prevents rapid resoiling of the carpet surface. However, some surfactant is preferable so as to improve wet out of the carpet surface.

The surfactants useful herein include anionic, nonionic, amphoteric, zwitterionic, or mixtures thereof including those with silicon or fluorine. It is preferable to the present invention to utilize low amounts of surfactant so as to leave a nontacky or nonsticky residue once the cleaning composition is dried. Sticky residue left behind after cleaning will quickly attract dirt and dust particles, discoloring the area where the residual surfactant remains.

Examples of suitable anionic surfactants include alkali metal or ammonium salts of fatty acids; alcohol sulfates; alcohol sulfonates; alcohol phosphates; sodium dioctyl sulfosuccinate; alcohol phosphonates; $C_8$ to $C_{22}$ alkyl sulfonates; disodium lauric sulfosuccinates; disodium lauramido MEA sulfosuccinates; salts of $C_8$ to $C_{20}$ alkylbenzene sulfonates; $C_8$ to $C_{22}$ primary or secondary alkane sulfonates; $C_8$ to $C_{24}$ olefin sulfonates; sulfonated polycarboxylic acids prepared by sulfonation of pyrolyzed product of alkaline earth metal citrates; $C_8$ to $C_{24}$ alkylpolyglycolether sulfonates containing up to 10 mols of ethylene oxide, and the like. Suitable salts herein refer particularly to sodium, potassium, ammonium, and substituted ammonium salts such as mono-, di-, and triethanolamine salts. Anionic surfactants are described in "Surface Active Agents and Detergents" Vol. I and II) by Schwatz, Perry and Berch. In a preferred embodiment, the anionic surfactants are selected from the group consisting of anionic sulfonate and sulfate surfactants. A specific example of an anionic surfactant is sodium lauryl sulfate available from various sources including Rholdia, Inc. in Cranbury, N.J. and Stepan Co. in Northfield, Ill.

Examples of suitable nonionic synthetic detergents or surfactants useful herein include linear ethoxylated medium to long chain alcohols; propoxylated/ethoxylated medium to long chain alcohols; ethoxylated nonylphenols; ethoxylated octylphenols; ethoxylated primary alcohols; ethylene oxide/propylene oxide block copolymers; condensation products of ethylene oxide, propylene oxide and/or butyleneoxide with $C_8$–$C_{18}$ alkylphenols; $C_8$–$C_{18}$ primary or secondary aliphatic alcohols; $C_8$–$C_{18}$ fatty acid amides; tertiary amine oxides with one $C_8$–$C_{18}$ alkyl chain and two $C_{1-3}$ alkyl chains.

Suitable anionic and nonionic surfactants are discussed in U.S. Pat. No. 5,534,167 and in U.S. Pat. No. 5,004,557 herein incorporated by reference in their entirety.

Examples of amphoteric or zwitterionic detergents are N-alkylamino acids, sulphobetaines, condensation products of fatty acids with protein hydrolysates. Amphoteric or zwitterionic surfactants are also discussed in U.S. Pat. No. 5,004,557 incorporated by reference above.

Mixtures of the various types of surfactants may also be used, and preference is given to mixtures of an anionic and a nonionic surfactants. Soaps, in the form of their sodium, potassium, and substituted ammonium salts such as of polymerized fatty acids, may also be used, preferably in conjunction with an anionic and/or a nonionic synthetic detergent.

Preferable surfactants for use in the present invention include the nonionic alcohol ethoxylates and the anionic alkyl sulfosuccinates.

Optionally, the cleaning compositions of the present invention may include cosolvents, dyes or colorants, fragrances or perfumes, antimicrobials, bleaches or brighteners, detergents, preservatives, viscosity control agents such as salts, pH adjusters or buffers, anti-static agents, softeners, insect repellents, mothproofing agents, enzymes, soil suspending agents, thickeners, and so forth. These types of additives, as well as many others, are known to one of skill in the art and are selected based on the specific end use of the composition.

The balance of the cleaning composition is water. The composition may comprise anywhere from about 55% to about 98% by weight water, and preferably from about 55% to about 95% by weight water.

Buffering agents may be utilized to adjust the pH of the compositions. It is desirable that the compositions have a pH of about 4 to about 10. Suitable buffering agents include amines and ammonium compounds such as 2-amino-2-methyl-1-propanol (amino alcohols) and ammonium hydroxide; salts and hydroxides of alkaline earth metals and alkali metals; alkaline earth metal, alkali metal and ammonium carbonates, bicarbonates, metasilicates and ortho phosphates; and so forth. This list is not exclusive and one of skill in the art would understand what compounds may be available for use as buffering agents. These can be added, if appropriate, at levels up to about 10% by weight to provide a compositional pH of about 4–10. Within this pH range it will be understood that some or all of the carboxylic acid groups of the emulsifier may be converted to salt form. Consequently the "acid copolymer" as described and claimed herein includes the salt forms which exist within this pH range.

In preferred embodiments of the present invention, ammonium hydroxide or sodium carbonate are used as the buffering agents. The present inventors have found that when these buffering agents are used, even surfactants that typically do not typically dry, may be used in the present invention. This has significantly increased the number and kinds of surfactants that may be utilized in the present invention. In a most preferred embodiment of the present invention, ammonium hydroxide is used as the buffering agent in combination with sodium dioctyl sulfosuccinate, a surfactant which itself does not dry. The composition dried and left no tacky residue on carpeting.

In contrast, when 2-amino-2-methyl- 1-propanol, a tacky compound in and of itself, is used as the buffering agent, the choice of surfactant must be made much more carefully. Surfactants that have been found to be particularly useful with 2-amino-2-methyl- 1-propanol include linear alcohol ethoxylate and tetrasodium N-(1,2-dicarboxyethyl) N-alkyl (C-18) sulfosuccinate. However, it has been noted that some surfactants that dry friable do not wet out surfaces well. One of skill in the art would know how to select a surfactant based on its drying and wetting ability.

The compositions of the present invention find utility as cleaning compositions. In particular, the compositions of the present invention are useful for cleaning carpets and rugs, for instance, due to the lack of tacky residue left behind.

EXAMPLES

Example 1

An emulsion of 0.2 wt-% PEMULEN® 1622, a high molecular weight acrylic copolymer (hydrophobically modified) supplied by the B.F. Goodrich Co.; 7.9 wt-% isoparaffinic hydrocarbon liquid; 0.07 wt-% sodium dioctyl sulfosuccinate; 0.12 wt-% ammonium hydroxide (26 BE) and the remainder water (91.68 wt-%) was prepared using standard procedures.

Motor oil was applied to various carpet pieces, nylon and olefin carpets, and allowed to condition overnight for a minimum of 12 hours. The emulsion was then applied to the stain and allowed to set briefly, i.e. less than 3 minutes. The spot was flushed with clear water using a commercial carpet extractor. The emulsion was then rated for cleaning on a scale of 1 to 3, a 1 indicating a high level of cleaning, and a 3 indicating a low level of cleaning. This sample was rated 1 for cleaning oil from both olefin and nylon carpeting. No tacky residue was noted.

Example 2

The following emulsion may be prepared for providing a composition useful for carpet cleaning that will leave a nontacky residue. The emulsion includes 0.2 wt-% PEMULEN® 1622 acrylic acid copolymer; 8.0 wt-% isoparaffinic hydrocarbon solvent; 0.5 wt-% linear alcohol ethoxylate surfactant, Surfonic® L24-7 available from Huntsman Corp. in Salt Lake City, Utah, and the balance water (91.3 wt-%). The solution may be buffered to a pH of 6 using 2-amino-2-methyl-1-propanol.

Examples 3–5

Examples 3–5 were prepared according to the invention and subsequently tested for cleaning performance. Used motor oil was applied to both nylon and olefin carpet, and a 1:1 ratio of 140 # gear lube:axel grease was applied to nylon carpet and allowed to condition on the carpeting overnight at a minimum (generally 12 hours minimum). The cleaning emulsion was then applied and left for approximately 1 minute and was then extracted with water using a commercial spotting extractor. The compositions were rated on a scale of 1–3 based on ability to clean and remove the spots: 1 being the most clean, 2 being moderate and 3 being the worst. A rating of 1 indicates that very little or no staining was visible. The results are shown in Table 1.

TABLE 1

| | Ex 3 | Ex 4 | Ex 5 |
|---|---|---|---|
| Water | 91.8 | 91.8 | 91.8 |
| Pemulen ® 1622 | 0.2 | 0.2 | 0.2 |
| Isopar ® K | 0.8 | — | — |
| Emery ® 2209 | — | 0.8 | — |
| Exxate ® 1000 | — | — | 0.8 |

TABLE 1-continued

| | Ex 3 | Ex 4 | Ex 5 |
|---|---|---|---|
| Nylon Carpet | | | |
| Oil Removal | 1 | 2 | 2 |
| Grease Removal | 1.5 | 2 | 2 |
| Olefin Carpet | | | |
| Oil Removal | 1 | 2.5 | 2.25 |

Pemulen ® 1622 - high molecular weight acrylic copolymer from B. F. Goodrich Co.
Isopar ® K - isoparaffinic hydrocarbon available from Exxon Chemical Co.
Emery ® 2209 - capric/caprylic methyl ester available from Henkel Corp.
Exxate ® 1000 - oxodecylacetate supplied by Exxon Chemical Co. in Houston, TX

Examples 6–7, Comparative Examples A–B

Examples 6 and 7 were prepared in order to test surfactant combinations for dryness. A 0.1–0.3 g sample was placed in a plastic petri dish or plastic weight boat and the emulsion was allowed to dry overnight. The compositions were then inspected by touch for tackiness or wetness. The results are shown in Table 2.

TABLE 2

| | Example 6 | Example 7 |
|---|---|---|
| Water | 91.5 | 91.3 |
| Pemulen ® 1622 | 0.2 | 0.2 |
| AMP-95 | 0.2 | 0.2 |
| Surfonic ® L24-7 | 0.1 | — |
| Monawet ® SNO-35 | — | 0.3 |
| Isopar ® K | 8.0 | 8.0 |
| Dry State | Dry | Dry |

Pemulen ® 1622 - high molecular weight acrylic copolymer from B. F. Goodrich Co.
Isopar ® K - isoparaffinic hydrocarbon
AMP-95 - 2-amino-2-methyl-1-propanol supplied by Angus Chemical Co. in Buffalo Grove, IL
Surfonic ® L24-7 - $C_{12}$–$C_{14}$ alcohol ethoxylate (7 moles ethylene oxide) supplied by Huntsman Corp.
Monawet ® SNO-35 - a tetrasodium N-(1,2-dicarboxyethyl)N-alkyl (C-18) sulfosuccinate available from Mona Industries, Inc. in Paterson, NJ

What is claimed is:

1. A carpet cleaning composition, comprising:

a) about 50% by weight to about 98% by weight of the composition of water;

b) about 0.05% by weight to about 2% by weight of the composition of at least one acid copolymer emulsifier having both a lipophilic and a hydrophilic portion;

c) a solvent component consisting of about 1% by weight to about 50% by weight of the composition of at least one solvent selected from terpene based hydrocarbons, water-insoluble esters, isoparaffinic hydrocarbons, naphthenic hydrocarbons, water-insoluble ketones, alkylated siloxanes, and mixtures thereof; and d) 0% to about 1% by weight of the composition of at least one surfactant;

said composition having an adjusted pH from about 4 to about 10.

2. The composition of claim 1 wherein said acid copolymer emulsifier has an acid number from about 10 to about 450.

3. The composition of claim 1 wherein said at least one acid copolymer emulsifier is employed in an amount of 0.1–1% by weight of the composition.

4. The composition of claim 1 wherein said acid copolymer emulsifier is prepared from at least one monomer selected from the group consisting of acrylic acid, methacrylic acid, ethacrylic acid, alpha-chloroacrylic acid, alpha-cyano acrylic acid, maleic acid, itaconic acid, fumeric acid, anhydrides of said acids, salts of said acids and mixtures thereof.

5. The composition of claim 1 wherein said acid copolymer emulsifier is an acrylic acid copolymer.

6. The composition of claim 1 wherein said acid copolymer emulsifier is a copolymer of a $C_{10}$ to $C_{30}$ alkyl acrylate with an olefinically unsaturated carboxylic acid monomer.

7. The composition of claim 1 wherein said at least one surfactant is employed in an amount of about 0.01% to about 0.5% by weight of the composition.

8. The composition of claim 1 wherein said at least one surfactant is selected from the group consisting of anionic, nonionic, amphoteric and zwitterionic surfactants, and mixtures thereof.

9. The composition of claim 8 wherein said at least one surfactant is selected from the group consisting of alcohol alkoxylates, dialkyl sulfosuccinates and mixtures thereof.

10. The composition of claim 9 wherein said at least one surfactant is a dialkyl sulfosuccinate.

11. The composition of claim 1 wherein the pH has been adjusted using a hydroxide of an alkali metal.

12. The composition of claim 1 wherein the pH has been adjusted using a carbonate of an alkali metal.

13. The composition of claim 1 wherein the pH has been adjusted using a compound selected from the group consisting of amines, ammonium and mixtures thereof.

14. The composition of claim 13 wherein the pH has been adjusted using an ammonium hydroxide.

15. The composition of claim 14 wherein the surfactant is a sodium dioctyl sulfosuccinate.

16. The composition of claim 1 further comprising a compound selected from the group consisting of dyes, fragrances, antimicrobials, bleaches, detergents, preservatives, viscosity control agents, buffers, anti-static agents, softeners, insect repellents, mothproofing agents, enzymes, soil suspending agents, thickeners, and mixtures thereof.

17. The composition of claim 1 wherein said solvent is water-insoluble.

18. The composition of claim 1 wherein said solvent has a vapor pressure of greater than 0.1 mm Hg.

19. The composition of claim 1 wherein said solvent is an isoparaffinic hydrocarbon.

20. The composition of claim 19 wherein said composition consists of about 3% to about 20% by weight of the composition of isoparaffinic hydrocarbon.

21. A carpet cleaning composition prepared by mixing:

a) about 50% to about 98% by weight of the composition of water;

b) about 0.05% to about 2% by weight of the composition of at least one acid copolymer emulsifier having both a lipophilic and a hydrophilic portion;

c) a solvent component consisting of about 1% to about 50% by weight of the composition of at least one solvent selected from the terpene based hydrocarbons, water-insoluble esters, isoparaffinic hydrocarbons, naphthenic hydrocarbons, water-insoluble ketones, alkylated siloxanes, and mixtures thereof;

d) 0% to about 1% by weight of the composition of at least one surfactant; and e) at least one alkaline compound;

said composition having an adjusted pH from about 4 to about 10.

22. The composition of claim 21 wherein said acid copolymer has an acid number from about 10 to about 450.

23. The composition of claim 1 wherein said acid copolymer has one comonomer that has a hydrophobic group thereon selected from aliphatic groups having 1–30 carbon atoms optionally substituted with alkoxy, halo, cyano, and ether oxygen atoms.

24. The composition of claim 1 wherein said acid copolymer has at least one monomer having the following general structure:

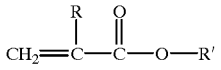

wherein R is a substituent selected from hydrogen, halogen, cyano, alkyl, aryl, aralkyl, alkaryl and cycloaliphatic, and R' is an optionally substituted alkyl group having 1 to 30 carbon atoms.

25. The composition of claim 1 wherein said solvent is a cyclic dimethyl siloxane.

26. A carpet cleaning composition, comprising:

a) about 50% by weight to about 98% by weight of the composition of water;

b) about 0.05% by weight to about 2% by weight of the composition of at least one acid copolymer emulsifier having both a lipophilic and a hydrophilic portion;

c) a solvent component consisting of about 1% by weight to about 50% by weight of the composition of at least one solvent selected from terpene based hydrocarbons, water-insoluble esters, isoparaffinic hydrocarbons, naphthenic hydrocarbons, water-insoluble ketones, alkylated siloxanes, and mixtures thereof;

d) 0% to about 1% by weight of the composition of at least one surfactant; and e) at least one alkaline compound selected from the group consisting of hydroxides, carbonates and bicarbonates of alkali metals;

said composition having an adjusted pH from about 4 to about 10.

27. The composition of claim 26 wherein said alkaline compound is ammonium hydroxide.

28. The composition of claim 26 wherein said alkaline compound is sodium carbonate.

* * * * *